US005318113A

United States Patent [19]

Potier

[11] Patent Number: 5,318,113

[45] Date of Patent: Jun. 7, 1994

[54] HEAT EXCHANGER WITH A BUNDLE OF PARALLEL TUBES, IN PARTICULAR FOR A MOTOR VEHICLE

[75] Inventor: Michel Potier, Rambouillet, France

[73] Assignee: Valeo Thermique Moteur, Le Mesnil-Saint-Denis, France

[21] Appl. No.: 88,869

[22] Filed: Jul. 8, 1993

[30] Foreign Application Priority Data

Jul. 9, 1992 [FR] France ..... 92 08543

[51] Int. Cl.[5] ..... F28F 9/04

[52] U.S. Cl. ..... 165/173; 165/175; 165/177

[58] Field of Search ..... 165/173, 175, 177

[56] References Cited

U.S. PATENT DOCUMENTS

| | | | |
|---|---|---|---|
| 4,309,987 | 1/1982 | Higgins, Jr. | 126/448 |
| 4,546,824 | 10/1985 | Melnyk | 165/153 |
| 4,682,650 | 7/1987 | Potier | 165/173 |
| 5,219,024 | 6/1993 | Potier | 165/173 |

FOREIGN PATENT DOCUMENTS

| | | | |
|---|---|---|---|
| 0429401A2 | 5/1991 | European Pat. Off. | F28F 9/02 |
| 8708104 | 9/1987 | Fed. Rep. of Germany | F28F 9/04 |
| 4107361 | 9/1991 | Fed. Rep. of Germany | 165/173 |

*Primary Examiner*—Allen J. Flanigan
*Attorney, Agent, or Firm*—Morgan & Finnegan

[57] ABSTRACT

A heat exchanger, especially a heat exchanger for use in a motor vehicle as an engine cooling or cabin heating radiator, comprises a bundle of parallel tubes, a header plate formed with holes, each of which receives the respective ends of a plurality of adjacent tubes forming part of a common group of tubes in the bundle, and a compressible sealing gasket interposed between the edge of the hole and the ends of the tubes in the group. At least one of the tube ends in a group of tubes received in any one hole in the header plate has a different geometry from the end of the other tube or tubes in the same group.

10 Claims, 1 Drawing Sheet

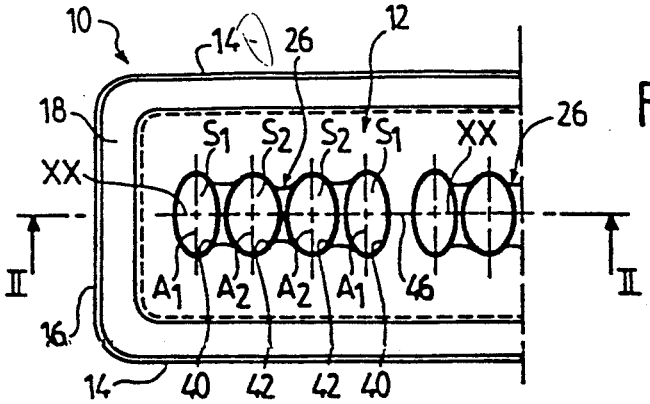
FIG. 1
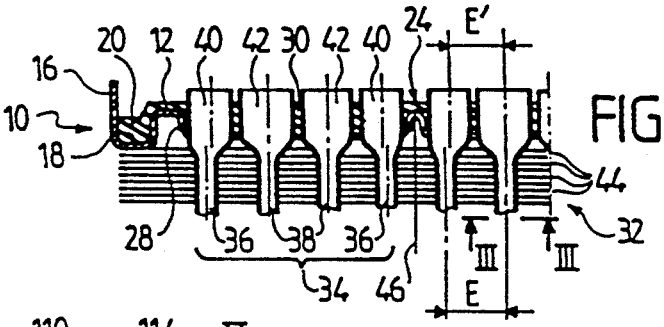
FIG. 2
FIG. 3
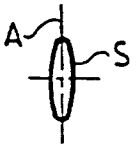
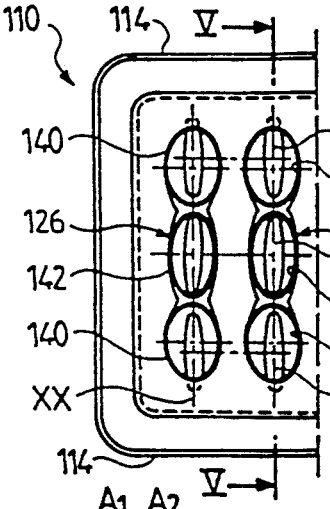
FIG. 4
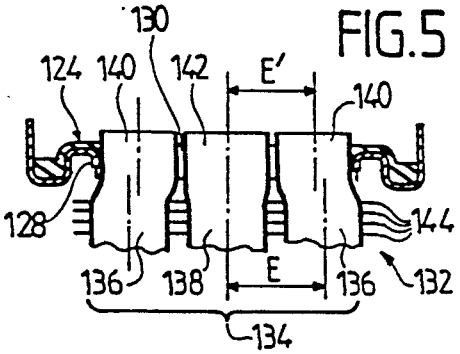
FIG. 5
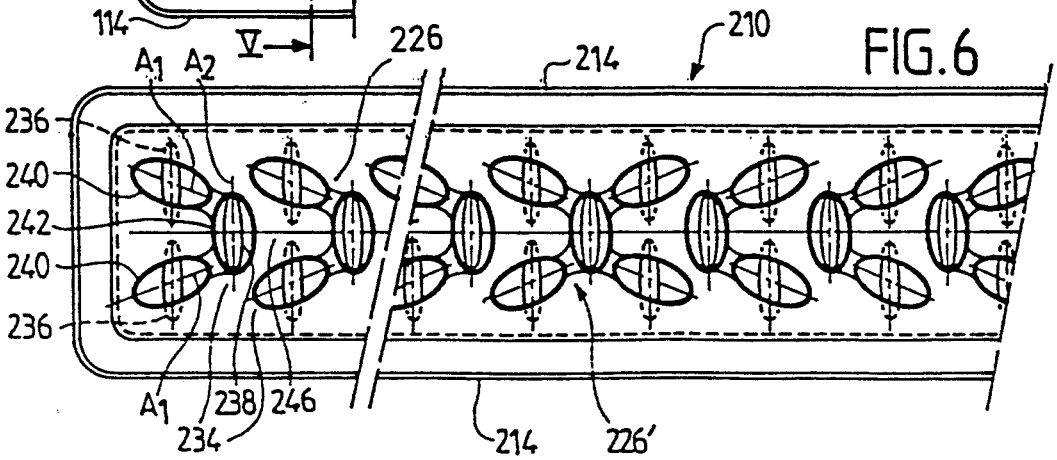
FIG. 6

HEAT EXCHANGER WITH A BUNDLE OF PARALLEL TUBES, IN PARTICULAR FOR A MOTOR VEHICLE

FIELD OF THE INVENTION

This invention relates to a heat exchanger of the kind comprising a bundle of parallel tubes, each having a respective end portion (referred to herein as an "end" or "tube end"), which is received in a hole formed through a header plate of the heat exchanger.

BACKGROUND OF THE INVENTION

Such heat exchangers, as is well known, are used especially in motor vehicles having internal combustion engines, so as to constitute either an engine cooling radiator or a cabin heating radiator. In either of these two applications, an engine coolant fluid, which is usually water with the addition of a suitable antifreeze preparation, flows through the tubes in the bundle, while a stream of air flows over the tubes in the bundle. In this familiar type of heat exchanger, it is usual to provide the same number of holes in the header plate as there are tubes in the bundle, so that each tube end is received individually in a respective hole in the header plate, to which it is sealingly secured.

In French patent application No. 91 03411 in the name of the present Applicant, a heat exchanger is proposed which is of the type comprising a bundle of parallel tubes and a header plate having holes, each of which receives the respective ends of a plurality of adjacent tubes which are part of a common group of tubes. A compressible sealing gasket is generally interposed between the edge of the hole and the tube ends in that group. Due to the fact that the respective ends of the tubes in a group are received in a single hole in the header plate, instead of each one being received individually in a separate hole of the plate, the pitch of the tubes is able to be reduced to a minimum value. In this way the thermal performance of the heat exchanger can be optimised while the dimensions of the header plate are minimised.

However, in the heat exchanger of the type just mentioned, the tubes of any one of the said groups are part of different rows of tubes in the bundle. In addition, this heat exchanger is most particularly suitable where there are two rows of tubes in the bundle, that is to say the latter is a twin-row bundle.

DISCUSSION OF THE INVENTION

Accordingly, one object of the present invention is to provide a heat exchanger of the type just mentioned, which may be applied to other structures of tube bundle.

Another object of the invention is to provide such a heat exchanger which is of small size.

A further object of the invention is to provide such a heat exchanger in which the manufacture of the header plate, and/or the assembly of the tube bundle on the latter, is improved.

According to the invention, a heat exchanger of the type comprising a bundle of parallel tubes, a header plate formed with holes, each of which receives the respective end portions of a plurality of adjacent said tubes defining one common group of tubes, and a compressible sealing gasket which is interposed between the edge of each hole and the ends of the tubes in the said group in that hole, is characterised in that at least one of the ends of the tubes in a said group of tubes received in a hole of the header plate has geometric characteristics which are different from those of the end of at least one other tube in that group.

The difference in geometric characteristics referred to above is intended to mean that the tube end concerned may have, in particular, an orientation, a coaxial relationship, and/or a cross section, which is different from those of another, or more than one other, tube end in the same group.

As a result, the heat exchanger constructed in accordance with the invention has a reduced size and/or improved manufacturing characteristics, as compared with the case if all the tube ends were similar as in the past. Due to the differences in geometric characteristics mentioned above, the header plate of the heat exchanger of the present invention may include integral bridges which are stronger between the holes in the header plate in which a respective group of tubes is received.

In a first type of embodiment of the invention, the ends of the tubes of the said group are disposed in aligned relationship, and form part of a common row of tubes of the said bundle.

Preferably, the ends of the tubes in the said group comprise two tube ends of outer tubes and at least one tube end of an intermediate tube, with each of the outer tube ends being offset towards the end of the adjacent intermediate tube. As a result, space is able to be made available as necessary, so as to enable the collars, each of which surrounds one of the holes in the header plate, to be raised. In addition, integral bridges are obtained, each of which extends between two adjacent holes in the header plate, and these bridges provide mechanical strength for the latter.

The above mentioned first type of embodiment of the invention is applicable, in particular, to a heat exchanger in which the ends of the tubes in the said group have cross sections of oval or elliptical shape having respective axes extending in parallel directions. In this case, it is preferably arranged that the cross sections of the ends of the outer tubes in the group are more elongated than the cross section of the end of the or each intermediate tube in the group.

In a second type of heat exchanger in accordance with the invention, in which the bundle consists of a plurality of rows of tubes, the ends of the tubes of a said group being in different said rows the said group comprises at least three tubes, namely two outer tubes and at least one intermediate tube, disposed in aligned relationship in a direction transverse to that of the said rows.

This second embodiment of the invention is applicable in particular to a heat exchanger in which the said ends of the tubes of the same group have an oval or elliptical shape in cross section, defining respective major axes of symmetry which are aligned with each other. According to a preferred feature of the invention, in this case it is then arranged that the tube end of the or each intermediate tube has a cross section which is more elongated than that of the tube ends of the outer tubes.

Preferably, the end of each outer tube is offset towards the end of the adjacent intermediate tube (138). This results in a heat exchanger in which the sealing gasket may be made to a minimum thickness between each of the outer tubes in the group and the intermediate tube which is next adjacent to it. In addition, the eccentricity of the intermediate tube or tubes is thereby limited.

In a third type of embodiment of the invention, in which, again, the tube bundle consists of a plurality of rows of tubes, the ends of the tubes in a said group being in different said rows, the said group comprises at least three tubes, namely two outer tubes and at least one intermediate tube, disposed in a quincunx pattern. Preferably, in this type of embodiment the end portion of each outer tube is oriented towards the end of the intermediate tube adjacent to it. In this way, the shape of each hole through the header plate is optimised, while at the same time an integral bridge, having a large enough mechanical strength, is arranged between two adjacent ones of these holes.

This third form of heat exchanger in accordance with the invention is also applicable, in preferred arrangements, to a header in which the tube ends themselves have cross sections of oval or elliptical shape, each defining a major axis of symmetry. Then, in accordance with another preferred feature of the invention, the major axis of the cross section of the end of a said outer tube is oriented towards the cross section of the end of the intermediate tube which is adjacent to it.

Some preferred embodiments of the invention will be described below by way of example only, and with reference to the accompanying drawings.

BRIEF DESCRIPTION OF THE DRAWINGS

FIG. 1 is a top plan view of a heat exchanger in a first embodiment of the invention, showing the header plate of the heat exchanger and the ends of the tubes which are received in the holes in the header plate, the sealing gasket being omitted so as to simplify the drawing.

FIG. 2 is a view in cross section taken on the line II—II in FIG. 1.

FIG. 3 is a view in cross section taken on the line III—III in FIG. 2.

FIG. 4 is a top plan view showing part of a heat exchanger in a second embodiment of the invention, showing a header plate of the heat exchanger and the ends of the tubes received in the holes in the header plate, the sealing gasket being omitted so as to simplify the drawing.

FIG. 5 is a view in cross section taken on the line V—V in FIG. 4, with the sealing gasket being shown in this Figure.

FIG. 6 is a top plant view showing part of a heat exchanger in a third embodiment of the invention, again showing a header plate of the heat exchanger and the ends of tubes which are received in the holes in the header plate; again the sealing gasket is omitted in the interests of simplification of the Figure.

DESCRIPTION OF PREFERRED EMBODIMENTS OF THE INVENTION

The heat exchanger shown in FIGS. 1 and 2 includes a header plate 10 or perforated plate, having a spine portion 12 of generally rectangular shape, which is preferably made of a metallic material. The header plate is bounded by two parallel edges 14 corresponding to the two major sides of the rectangle, and two further parallel edges 16 (only one of which can be seen in FIGS. 1 and 2), corresponding to the minor sides of the rectangle. The edges 14 and 16 define a peripheral groove 18 of generally rectangular contour, which surrounds the spine portion 12 of the header plate 10. The groove 18 is arranged to receive a peripheral bead 20 (FIG. 2) which is part of a sealing gasket 24. The gasket 24 covers the spine portion 12 of the header plate in a known manner.

A set of oblong holes 26 is formed through the spine portion 12. FIG. 1 shows one of these holes complete, and part of another one. Each of these holes 26 defines an axis of symmetry XX extending parallel to the length of the header plate, half-way between the two long edges 14, with the axes of symmetry of the holes 26 being thus aligned with each other as can be seen in FIG. 1. Each hole 26 is bounded by a collar 28 (FIG. 2), and the gasket 24 has another collar 30 corresponding to each hole 26. Each collar 30 is arranged to bear against the collar 28 of the corresponding hole 26.

The heat exchanger in FIGS. 1 and 2 also includes a tube bundle 32 (FIG. 2), consisting of a multiplicity of tubes which are arranged in a single row and divided into a plurality of groups 34. In this example, each group 34 consists of four tubes, namely two outer tubes 36 and two intermediate tubes 38. The outer tubes 36 have end portions 40, and the intermediate tubes 38 have end portions 42 lying between the two end portions 40 of the outer tubes in the same group. The two end portions 40 and the two end portions 42 are introduced into a common hole 26, so as to compress the collar 30 of the sealing gasket 24.

The tubes 36 and 38 have identical oval cross sections S (see FIG. 3), each defining a major axis A which extends at right angles to the edges 14 of the header plate 10. The tubes extend through a multiplicity of fins 44 parallel to each other.

The tube ends 40 and the tube ends 42 are expanded so as to compress the collar 30 of the gasket within the corresponding collar 28 of each hole 26, so guaranteeing good sealing at the level of the junction of the tube ends with the header plate. Because of their expanded configuration, the tube ends 40 and 42 have a cross section which is different from the cross section S of the body of each tube seen in FIG. 3.

As shown in FIG. 2, the tube end 40 of each outer tube 36 is offset towards the tube end 42 of the adjacent intermediate tube 38. The tube ends 40 and 48 are thus set at a pitch E' which is smaller than the pitch E of the tubes 38 and 36 themselves. In this way, a space is formed between two adjacent holes 26, and is large enough to enable the collars 28 of the header plate to be raised, and also to enable an integral bridge 46 to be provided in the header plate, with a width which is large enough to give the header plate the required mechanical strength.

The end portions of the outer tubes have cross sections $S_1$, each of which defines a major axis of symmetry $A_1$, while the end portion 42 of each intermediate tube has a cross section $S_2$ defining a major axis of symmetry $A_2$. The axes $A_1$ and $A_2$ extend in directions parallel to each other and at right angles to the edges 14 of the header plate 10. In addition, the cross sections $S_1$ of the tube ends 40 are more elongated than the sections $S_2$ of the tube ends 42.

Reference is now made to FIGS. 4 and 5, showing a second embodiment of the invention in the form of another heat exchanger. In FIGS. 4 and 5, those elements which correspond to elements in the heat exchanger shown in FIGS. 1 and 2 are indicated by the same reference numerals increased by 100.

The heat exchanger shown in FIGS. 4 and 5 comprises a header plate 110 of generally rectangular shape, formed with a plurality of holes 126 of elongated shape.

Each hole 126 defines an axis of symmetry XX extending along the header plate and at right angles to the edges 114 of the header plate 110.

In this example, the heat exchanger has a tube bundle 132 which consists of a multiplicity of tubes arranged in three rows. These tubes are spaced apart in groups 134, each of which consists of three tubes, i.e. two outer tubes 136 and one intermediate tube 138. The tubes of each group are arranged adjacent to each other and are part of different rows of tubes in the bundle, with the three tubes of one group being aligned with each other. The tubes 136 and 138 all have oval or elliptical cross sections, which are identical or similar to the cross section S in FIG. 3, the respective major axes of the cross sections of the tubes in any one group being extensions of each other.

The tubes 136 have respective tube ends 140 having an oval or elliptical cross section $S_1$ defining a major axis $A_1$. The intermediate tube 138 has a tube end 142 with oval or elliptical cross section $S_2$ and an axis $A_2$. The two tube ends 140 lie on either side of the tube end 142, with all three being received in one hole 126, and being expanded so as to squeeze the collar 130 of the sealing gasket 124 against the collar 138 of the header plate 110. As is best seen in FIG. 4, the cross sections $S_2$ of the intermediate tube ends 142 are more elongated than the cross sections $S_1$ of the outer tube ends 140.

In addition, each of the tube ends 140 is offset towards the tube end 142 of the intermediate tube 138 adjacent to it. The ends 140 and 142 define a pitch E' which is smaller than the pitch E of the corresponding tubes 136 and 138. As a result, the gasket 124 may have a minimal thickness between the tube end 142 and the two tube ends 140. In addition, because the tube end 142 has a cross section $S_2$ which is more elongated than the cross section $S_1$ of the tube ends 140, the eccentricity of the ends 140 is limited.

Referring now to FIG. 6 showing a third embodiment of the invention, here the reference numerals of those elements which common with the heat exchanger of FIGS. 1 and 2 are the same as in the latter, but increased by 200.

The header plate 210 in this example has a plurality of holes 226 which are adapted so that each hole receives the respective end portions of three tubes in a common group 234 of tubes in the bundle. Each group 234 comprises two outer tubes 236 and an intermediate tube 238, which are part of three respective, different rows of the bundle, and which are disposed in a quincunx formation. The three tubes all have the same cross section, with the respective major axes of the cross sections of the tubes 236 being aligned with each other at right angles to the edges 214 of the header plate 210. The major axis of the cross section of the tube 238 is also at right angles to the edges 214, but it extends parallel to the respective major axes of the cross sections of the tubes 236.

The outer tubes 236 have respective tube ends 240 of oval or elliptical shape defining a cross section $S_1$ with a major axis $A_1$, while the intermediate tube 238 has a tube end 242 of oval or elliptical shape, defining a cross section $S_2$ which is identical to that of the tube ends 240 and which has a major axis of symmetry $A_2$. This axis $A_2$ of the cross section of each of the tube ends 240 is oriented towards the section $S_1$ of the end 242 of the intermediate tube.

The major axis $A_2$ of the tube end 238 extends at right angles to the edges 214 of the header plate 210, while the respective major axes $A_1$ of the tubes extend obliquely with respect to the edges 214.

Each of the holes 226 has a form which is adapted to receive the end portion 238 and the two end portions 240, this shape being similar to that of a letter U. This shape enables the tube end 238 and both tube ends 240 to be mounted in only one hole, while forming integral bridges 246 which are large enough, between two adjacent holes 226, to give the header plate 210 the required mechanical strength.

It should be noted that the header plate has at its centre a hole 226' which has a generally X-shaped structure for receiving one tube end 242 flanked by four tube ends 240.

The invention is applicable most particularly to the manufacture of heat exchangers for motor vehicles.

What is claimed is:

1. A heat exchanger comprising: a header plate formed with a plurality of through holes; a bundle of parallel tubes, each having a tube end, the tubes being arranged in groups with the tube ends of those in each group being received in a respective common one of the said holes; and a compressible sealing gasket interposed, in each said hole, between the edge of the hole and the tube ends of the group of tubes in that hole, wherein at least one of the tube ends in each said group has a different geometry from the other tube end or ends in the same group.

2. A heat exchanger according to claim 1, wherein the tubes are arranged in the said bundle in at least one row, the tubes of a said group being part of the same said row, with the said ends of the tubes in the group being aligned with each other.

3. A heat exchanger according to claim 2, wherein the tube ends in each group comprise two outer tube ends and at least one intermediate tube end between the outer tube ends, each said outer tube end being offset towards the intermediate tube end adjacent thereto.

4. A heat exchanger according to claim 3, wherein each said tube end in a said group has an oval or elliptical cross section defining a respective axis, the said axes being parallel, with the said cross sections of the outer tube ends being more elongated than that of the intermediate tube end or ends in the group.

5. A heat exchanger according to claim 1, wherein the tubes are arranged in a plurality of rows in the said bundle, with each said group comprising the said ends of tubes in different rows, the group comprising two outer tubes and at least one intermediate tube disposed between the said outer tubes, the tube ends in the group being aligned with each other in a direction transverse to the said rows.

6. A heat exchanger according to claim 5, wherein each tube end of a said group has an oval or elliptical cross section defining a respective major axis, the said major axes being aligned with each other, the said end of the or each intermediate tube having a cross section which is more elongated than the cross section of either said end of the outer tubes in the group.

7. A heat exchanger according to claim 5, wherein each outer tube end in the group in offset towards the adjacent intermediate tube end.

8. A heat exchanger according to claim 1, wherein the tubes are arranged in a plurality of rows in the bundle, with tubes of different said rows having their ends constituting a said group in a common said hole in the header plate, the group comprising two outer tubes and at least one intermediate tube arranged between the outer tubes, the tubes in the group being arranged in a quincunx formation.

9. A heat exchanger according to claim 8, wherein the said end of each outer tube of a said group is oriented towards the said end of the adjacent intermediate tube.

10. A heat exchanger according to claim 8, wherein the said tube ends have oval or elliptical cross sections, each defining a major axis of symmetry, the major axis of symmetry defined by the tube end of an outer tube of the group being oriented towards the cross section of the said end of the adjacent intermediate tube.

* * * * *

UNITED STATES PATENT AND TRADEMARK OFFICE

CERTIFICATE OF CORRECTION

PATENT NO. : 5,318,113

DATED : 6/7/94

INVENTOR(S) : Michel Potier

It is certified that error appears in the above-indentified patent and that said Letters Patent is hereby corrected as shown below:

In claim 7, column 6, line 61, delete the word "in" (second occurrence) and insert therefor the word —is—.

Signed and Sealed this

Third Day of January, 1995

Bruce Lehman

*Attest:*

BRUCE LEHMAN

*Attesting Officer*

*Commissioner of Patents and Trademarks*